US009702557B2

(12) United States Patent
Sugiyama

(10) Patent No.: US 9,702,557 B2
(45) Date of Patent: Jul. 11, 2017

(54) GLOW PLUG

(71) Applicant: NGK SPARK PLUG CO., LTD., Nagoya-shi, Aichi (JP)

(72) Inventor: Yumi Sugiyama, Konan (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 454 days.

(21) Appl. No.: 14/395,308

(22) PCT Filed: Apr. 18, 2013

(86) PCT No.: PCT/JP2013/002617
§ 371 (c)(1),
(2) Date: Oct. 17, 2014

(87) PCT Pub. No.: WO2013/157266
PCT Pub. Date: Oct. 24, 2013

(65) Prior Publication Data

US 2015/0108116 A1 Apr. 23, 2015

(30) Foreign Application Priority Data

Apr. 20, 2012 (JP) ..... 2012-096331

(51) Int. Cl.
*H05B 3/40* (2006.01)
*F23Q 7/00* (2006.01)

(52) U.S. Cl.
CPC ..... *F23Q 7/001* (2013.01)

(58) Field of Classification Search
CPC ..... F23Q 7/001; F23Q 7/004; F23Q 7/002
See application file for complete search history.

(56) References Cited

FOREIGN PATENT DOCUMENTS

| | | | |
|---|---|---|---|
| JP | 10-259914 | A | 9/1998 |
| JP | 2000-220828 | A | 8/2000 |
| JP | 2009-158431 | A | 7/2009 |
| JP | 2011-012898 | A | 1/2011 |

OTHER PUBLICATIONS

International Search Report (PCT/ISA/210) issued Jul. 16, 2013, in related International Application No. PCT/JP2013/002617.
Written Opinion (PCT/ISA/37) issued Jul. 16, 2013, in related International Application No. PCT/JP2013/002617.

*Primary Examiner* — Shawntina Fuqua
(74) *Attorney, Agent, or Firm* — Sughrue Mion, PLLC

(57) ABSTRACT

A glow plug (1) provided with heat-producing coil (9) inside tube (7). When a vertical cross-section including a center axial line CL2 is observed, a specific cross-sectional region (21) satisfies a>b, where a (mm) is a length along a direction of an axial line CL1, and b (mm) is a length along a direction perpendicular to the axial line CL1. In addition, an inner appearance line (221) of the specific cross-sectional region 21 satisfies R>a/2 in a range positioned between predetermined points P1 and P3, wherein R (mm) is a curvature radius. Moreover, 0.100<L/b≤0.144 is preferably satisfied, wherein L (mm) is a distance from the inner appearance line through a virtual straight line VL, allowing an area of a region close to the inner appearance line in the region (21) to be 10% of an entire area of the region (21).

3 Claims, 8 Drawing Sheets

GLOW PLUG

TECHNICAL FIELD

The present invention relates to a glow plug used for ignition assistance or the like for a diesel engine.

BACKGROUND ART

Because of being used for ignition assistance or the like for a diesel engine, as a glow plug to be mounted to a cylinder head of the engine, one having a sheath heater, in which a helical heat-producing coil formed of an alloy having Fe or Ni as a primary constituent is encapsulated with insulating powders inside a tubular tube having a closed front end, has been known (see PTL 1, for example).

In recent years, for the purpose of attempting emission reduction or the like, it has been desired to rapidly rising a temperature of the sheath heater. In order to attempt to improve rapid temperature rising performance, it can be considered that a large electric current (for example, 30 A and around) is supplied to the glow plug by a predetermined energization control apparatus in an initial stage of energization.

CITATION LIST

Patent Literature

PTL 1: JP-A-2009-158431

SUMMARY OF INVENTION

Technical Problem

However, when such a large electric current is supplied to the heat-producing coil, there is concern that the heat-producing coil is over-heated, thus leading to melting damage. Especially, when a cross-sectional shape of a winding wire itself of the heat-producing coil encapsulated in the tube is in the form of common circle (exact circle), and a large electric current is supplied thereto, an electric current density is likely to concentrate in an inner portion of the heat-producing coil, which causes over-heating to take place easily.

The present invention has been made in view of the above, and an objective thereof is, aiming at realizing preferable rapid temperature rising performance, to provide a glow plug that is capable of favorably preventing melting damage of a heat-producing coil, even when a large electric current is supplied to the heat-producing coil.

Solution to Problem

In the following, explanations will be made, item by item, about each configuration suitable for accomplishing the above objective. Incidentally, operational effects of corresponding configurations are noted when necessary.

Configuration 1: A glow plug according to this configuration comprises:

a tubular tube that extends along a direction of an axial line and is closed at a front end portion thereof; and a heat-producing coil that is helically wound, arranged inside the tube substantially coaxially with the tube, and joined at an own one end to the front end portion of the tube, wherein, in a specific cross-sectional region that is one of cross-sectional coil regions of the heat-producing coil observed in a vertical cross-sectional surface including a center axial line of the tube, a>b is satisfied, wherein a (mm) is a length of the specific cross-sectional region along the direction of the axial line, and b (mm) is a length of the specific cross-sectional region along a direction perpendicular to the axial line, and an inner appearance line, which is a line segment positioned on the side close to the center axial line within an appearance line of the specific cross-sectional region, is in a form of a straight line or a curved line, the curved line being convex toward the center axial line so that R>a/2 is satisfied wherein R is a curvature radius R (mm), in a range positioned between both end points among three points that divide the inner appearance line into quarters along the axial line direction.

Incidentally, a "radius curvature R" indicates a radius of a virtual circle that passes through the above three points (the same shall apply hereinafter).

From vigorous investigations about melting damage of the heat-producing coil at the time of supplying a large electric current by the inventor(s) of the present invention, it has been found that the melting damage is likely to take place especially in a portion (inner portion) positioned on the center axial side of the heat-producing coil. And, it has been discovered that by appropriating a cross-sectional shape of a winding wire itself, especially a shape (or configuration) of a portion of a cross-sectional coil region (specific cross-sectional region), the portion being close to an inner appearance line, an electric current density can be reduced (or dispersed), thereby suppressing regional over-heating of the inner portion.

In view of this point, according to a glow plug of the above configuration 1, the specific cross-sectional region, which is one of the coil cross-sectional regions, has a shape that satisfies a>b. Therefore, an area ratio of the portion (inner portion) positioned in a predetermined range from the innermost portion (portion closest to the center axial line) toward outside, of the cross-sectional region, with respect to an entire area of the specific cross-sectional region can be relatively large.

Moreover, according to this glow plug, the inner appearance line is configured in the form of straight line, or curved shape that is convex toward the axial line and has a curvature radius R greater than a/2, in a range positioned between the both end points of the three points. Namely, the inner appearance line does not have a shape having a portion that excessively protrudes toward the inner side (toward the center axial line), but is in the form of straight line or smoothly curved shape. Because the specific cross-sectional region takes such a shape, the area ratio of the inner portion with respect to the entire area of the specific cross-sectional region can be sufficiently large, so that the electric current density can be lowered at the time of energizing the glow plug (the heat-producing coil) in the inner portion of the heat-producing coil in which the area ratio is ensured to be large. As a result, in order to realize a preferable rapid temperature rising performance, even when a large electric current is supplied to the heat-producing coil, melting damage of the heat-producing coil can be prevented.

Configuration 2: The glow plug according to this configuration, wherein when L (mm) is defined as a distance along the direction perpendicular to the axial line from a portion closest to the center axial line within the inner appearance line through a virtual straight line drawn at a position in the specific cross-sectional region in parallel with the axial line, the position allowing an area of the thus formed region closer to the inner appearance line to be 10% of an entire area of the specific cross-sectional region, $0.100<L/b\leq0.144$ may be satisfied.

According to this glow plug, by setting a relationship between the distance L and the distance b to be $0.100<L/b\leq0.144$, a portion where an electric current path becomes extremely short is not formed especially in the portion (inner portion) positioned on the side close to the center axial line, so that a portion where an electric current easily flows at the time of energization is formed over a wider range in a direction of an axial line of the inner portion. With this, coupled with an effect of setting a shape of the inner appearance line of the specific inner portion to be a specific shape, the electric current density can be lowered in the inner portion of the heat-producing coil at the time of energizing the glow plug (heat-producing coil). As a result, even when a large electric current is supplied to the heat-producing coil, melting damage of the heat-producing coil can be further surely prevented. Incidentally, by setting L/b to be a value greater than 0.100, an edge portion having substantially a right angle, which allows the electric current density to be easily concentrated, is not caused in an inward portion of the specific cross-sectional region, thereby lowering the electric current density.

Configuration 3: The glow plug according to this configuration, in the above configuration 1 or 2, the inner appearance line in the specific cross-sectional region may be in a form of a curved line convex toward the center axial line in the range positioned between the both end points, and $0.03\leq a\leq1.00$, $0.010\leq b\leq0.30$, and $R\geq1.00$ may be satisfied.

According to this glow plug, it becomes possible to further effectively disperse the electric current density, and thus melting damage of the heat-producing coil can be further surely prevented.

Moreover, according to this glow plug, because of being configured so as to satisfy $a\leq1.00$, the number of windings of the heat-producing coil can be ensured relatively large, thereby sufficiently increasing a resistance value of the heat-producing coil. As a result, a rapid temperature rising performance of the heat-producing coil can be enhanced. In addition, because of being configured so as to satisfy $0.10\leq b$, a preferable mechanical strength of the heat-producing coil can be obtained.

Configuration 4: The glow plug according to this configuration, in any one of the above configurations 1 through 3, the heat-producing coil may have a volume resistivity of 1.0 μΩ·m or greater.

According to this glow plug, because a volume resistivity of the heat-producing coil is 1.0 μΩ·m or greater, the electric current density can be further smaller at the time of energizing the heat-producing coil, and melting damage of the heat-producing coil can be effectively suppressed, even when a large electric current is supplied.

BRIEF DESCRIPTION OF DRAWINGS

FIG. 7 is an enlarged cross-sectional view illustrating a coil cross-sectional region (a specific cross-sectional region), for explaining a distance L or the like.

DESCRIPTION OF EMBODIMENTS

In the following, embodiments will be explained with reference to the drawings.

First Embodiment

Figure 1:
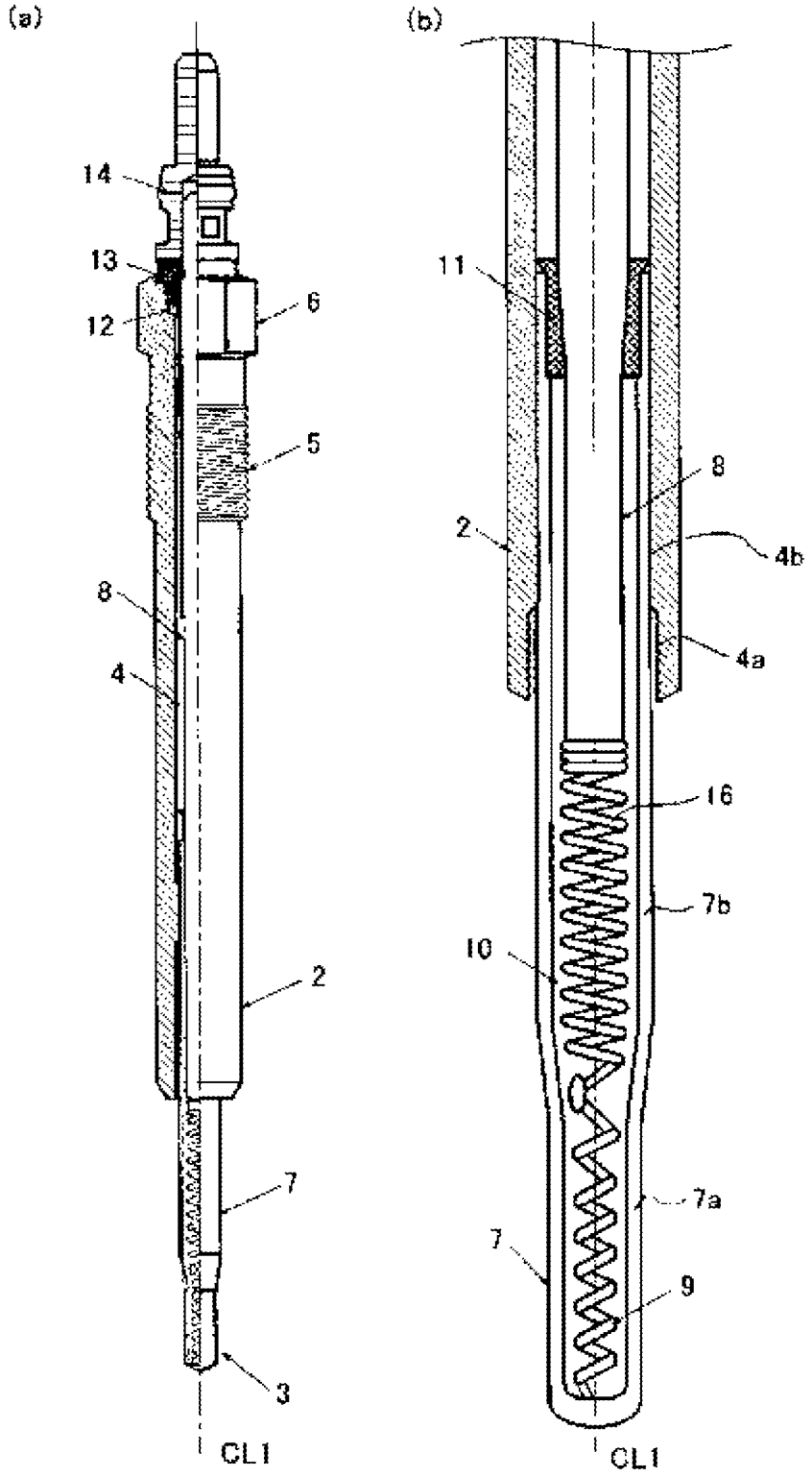
FIG. 1 (*a*) is a partially broken front view of a glow plug of a first embodiment; and (*b*) is an enlarged cross-sectional view of the glow plug of the first embodiment.

FIG. 1(*a*) is a cross-sectional view (a partially broken front view) of a glow plug 1 having a sheath heater 3, and FIG. 1(*b*) is a partially enlarged cross-sectional view of a front end portion of the glow plug 1. Incidentally, in FIG. 1, explanations will be made, assuming a lower side of the drawings (paper face) as a front end side of the glow plug 1 (the sheath heater 3), and an upper side as a rear end side.

The glow plug 1 is provided with a tubular housing 2 formed of a predetermined metal, and the sheath heater 3 mounted on an inner circumference of the housing 2.

The housing 2 has a through hole 4 that penetrates therethrough in a direction of an axial line CL1. On an outer circumferential surface thereof, a thread portion 5 for being attached to a cylinder head or the like of a diesel engine, and a tool engaging portion 6 that is in the form of hexagonal cross-sectional shape for allowing a tool such as a torque wrench or the like to be engaged thereto are formed.

The sheath heater 3 is configured of a tube 7 and a center shaft 8 that are integrated in the direction of the axial line CL1.

The tube 7 is in the form of tube with a closed end portion and formed of a metal having iron (Fe) or nickel (Ni) as a primary constituent. A small diameter portion 7*a*, which has been narrowed by a swaging process, is provided on the front end side; and a large diameter portion 7*b* whose outer diameter is larger than that of the small diameter portion 7*a* is provided on the rear end side. In addition, a heat-producing coil 9 whose primary objective is to produce heat and that is made of a predetermined metal (for example, a Ni-Chromium (Cr) alloy, a Fe—Cr alloy, or the like) is provided inside the tube 7 (the small diameter portion 7*a*). A front end portion of the heat-producing coil 9 is joined to a front end portion of the tube 7. Moreover, within the tube 7, a control coil 16 whose primary objective is to limit an electric current that flows through the heat-producing coil 9 by use of an increased resistance value of its own with a rise in temperature is provided so as to join to a rear end portion of the heat-producing coil 9 (join in series).

In addition, within the tube 7, insulating powders 10 (for example, MgO powders) are filled around the heat-producing coil 9 and the control coil 16. Therefore, while the heat-producing coil 9 electrically communicates at the front end thereof with the tube 7, an outer circumferential surface of the heat-producing coil 9 and an inner circumferential surface of the tube 7 are insulated by the intervening insulating powders 10. Even about the control coil 16, the intervening insulating powders 10 enables insulation with respect to the tube 7.

Moreover, the rear end portion of the tube 7 is sealed against the center shaft 8 by a sealing portion 11 in the form of ring, so that the inside of the tube 7 is sealed in a watertight manner.

In addition, in the through hole 4, a large diameter portion 4*a* is formed in a front end portion thereof; and a small diameter portion 4*b* is formed on the rear end side of the large diameter portion 4*a*. The tube 7 is press fitted into the small diameter portion 4*b* of the through hole 4 and fixed therein, and thus is held so as to protrude from a front end portion of the housing 2.

The center shaft 8 is inserted into the through hole 4 of the housing 2, and a front end thereof is inserted into the tube 7 and connected to a rear end of the control coil 16. In addition, a rear end portion of the center shaft 8 protrudes from a rear end of the housing 2. In a rear end portion of the housing 2, members such as an O-ring 12 made of rubber or the like and an insulating bushing 13 made of a resin or the like are arranged on an outer circumference of the center shaft 8. Moreover, a terminal 14 for connecting a power cable, in the configuration of being placed on a rear end of the insulating bushing 13, is covered over a rear end portion of the center shaft 8, and caulked to be fixed on the center shaft 8.

Figure 2:
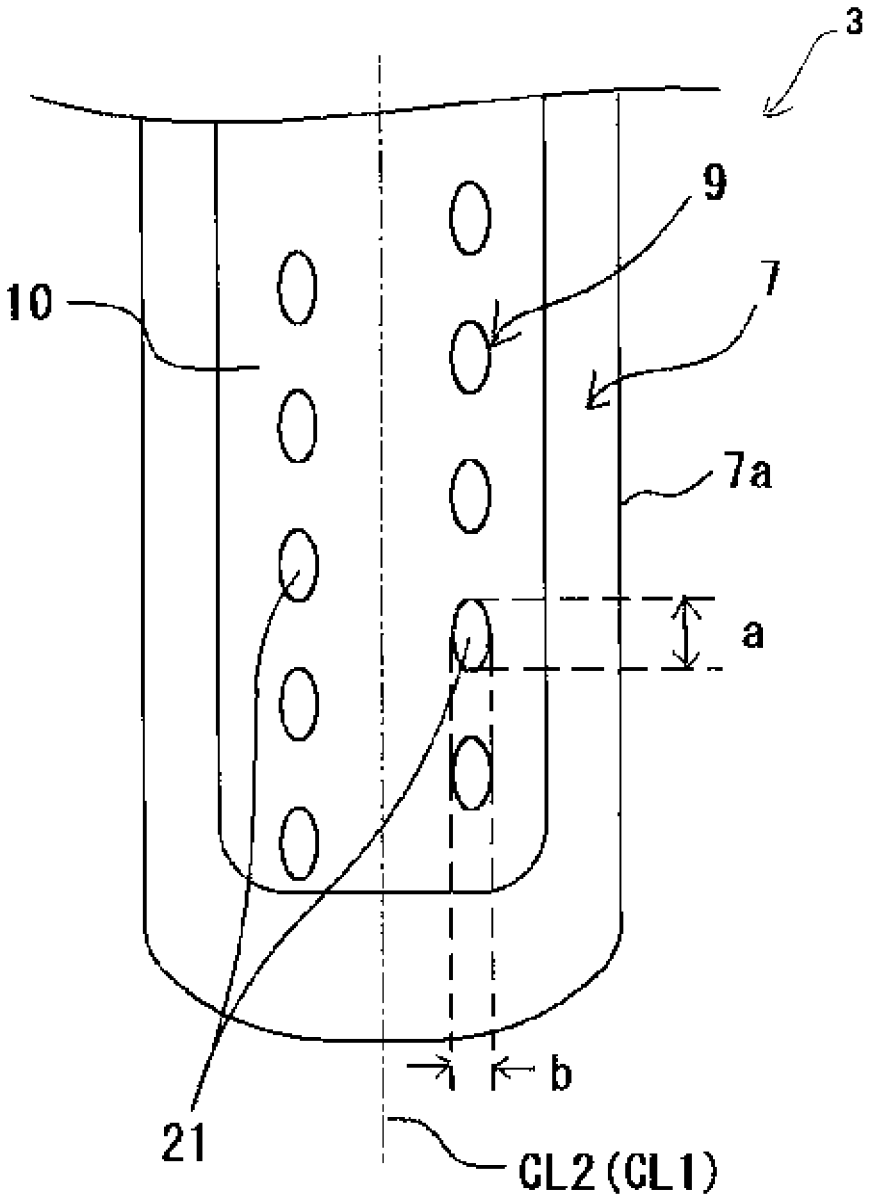
FIG. 2 is an enlarged cross-sectional view (vertical cross-sectional view) of a sheath heater front end portion (a front end side portion of a small diameter portion of a tube) of the glow plug of the first embodiment.
Figure 3:
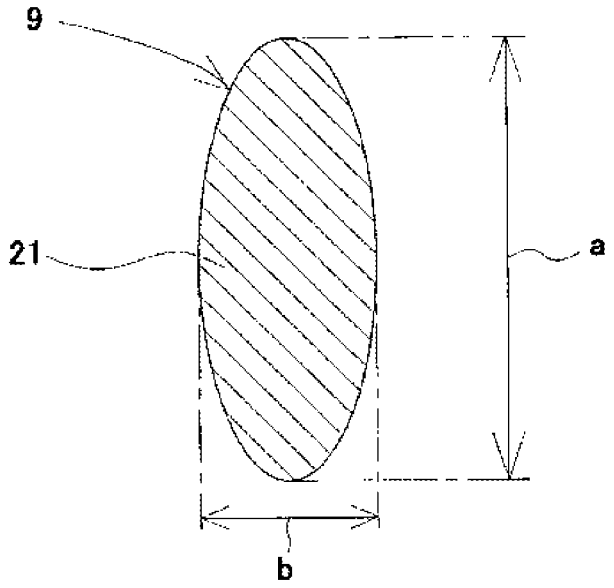
FIG. 3 is an enlarged cross-sectional view illustrating coil cross-sectional regions of a heat-producing coil (a specific cross-sectional region) in the first embodiment.

Here, the glow plug 1 according to the first embodiment is configured so that when a vertical cross section including a center axial line CL2 of the tube 7 is observed, a>b is satisfied in a specific cross-sectional region 21, which is one of cross-sectional coil regions of the heat-producing coil 9, as illustrated in FIGS. 2 and 3, where a (mm) is a length of the specific cross-sectional region 21 along the direction of the axial line CL1, and b (mm) is a length of the specific cross-sectional region 21 along a direction perpendicular to the direction of the axial line CL1.

Figure 4:
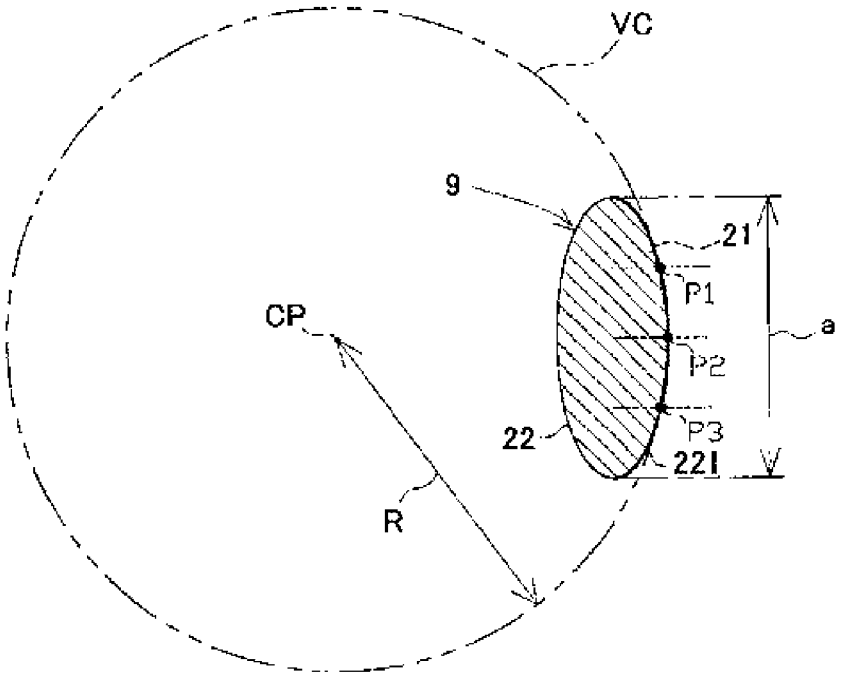
FIG. 4 is an enlarged cross-sectional view of the specific cross-sectional region, for explaining a curvature radius R.

As illustrated in FIG. 4, a line segment of an appearance line 22 that configures the specific cross-sectional region 21 of the heat-producing coil 9, an arc being positioned on the side close to the center axial line CL2 of the tube 7, is assumed as an inner side appearance line 221 (a portion indicated by a bold line in FIG. 4). The inner side appearance line 221 is in the form of curved line that is convex toward the center axial line CL2 so that R>a/2 is satisfied, where R (mm) is a curvature radius in a range positioned between points P1 and P3, which are end points among three points P1, P2, P3 that divide the inner side appearance line 221 into quarters along the axial line CL1. Incidentally, the curvature radius R means a radius of a virtual circle VC that is centered at a center point CP and passes through the points P1, P2, P3. In addition, the inner side appearance line 221 of the specific cross-sectional region 21 is configured so that the range positioned between the both end points P1 and P3 comes closest to the center axial line CL2 of the tube 7.

Figure 5:
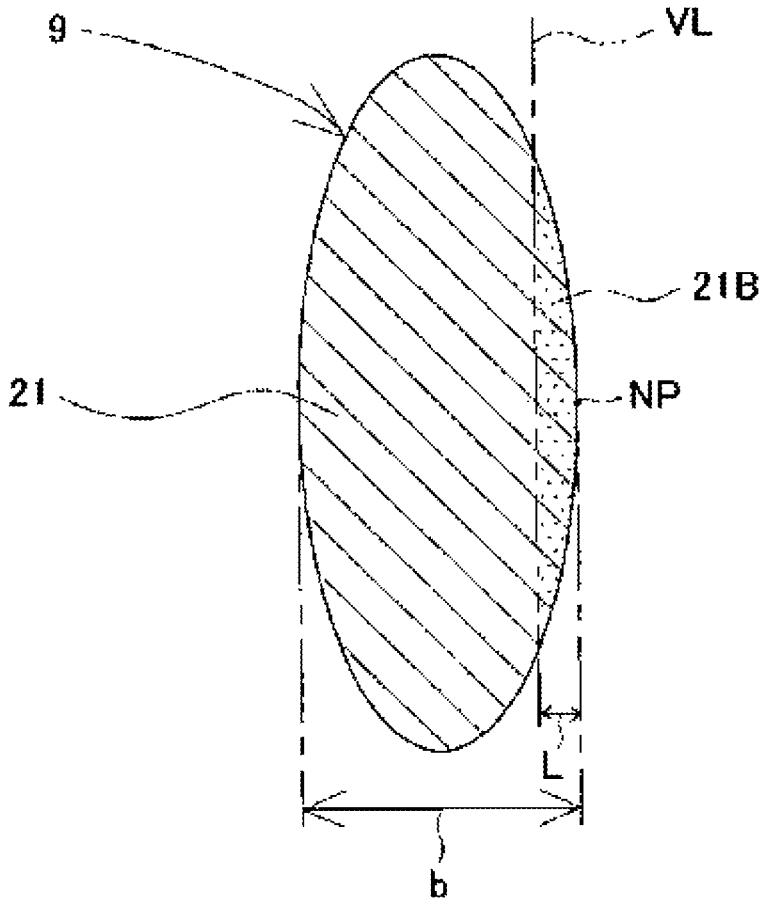
FIG. 5 is an enlarged cross-sectional view of the specific cross-sectional region, for explaining a distance L.

In addition, as illustrated in FIG. 5, a virtual straight line VL that extends in parallel with the axial line CL1 is drawn in such a manner that an area of a region 21B (a portion given with a dot pattern in FIG. 5) that is close to the inner side appearance line 221 within the specific cross-sectional region 21 is 10% of an entire area of the specific cross-sectional region 21. In this case, a relationship 0.100<L/b<0.144 is satisfied, where L is a distance along a direction perpendicular to the axial line CL1 from a portion NP that is the closest to the center axial line CL2 within the specific cross-sectional region 21 through the virtual straight line VL.

Furthermore, in the specific cross-sectional region 21 of the glow plug 1 of the first embodiment, relationships 0.30≤a≤1.00, 0.10≤b≤0.30, and R≥1.00 are satisfied. In addition, the heat-producing coil has a volume resistivity of 1.0 μΩ·m or greater.

Next, a method of producing the glow plug 1 is explained. Known methods are employed about portions that are not explicitly mentioned.

First, in an intermediary coil forming step, a resistive heat-producing wire that contains Ni or Fe as a primary constituent and has a circular cross-sectional shape is helically wound, thereby producing a first intermediary coil to be turned into the heat-producing coil 9. Apart from this, a second intermediary coil to be turned into the control coil 16 is produced. In addition, an intermediary tube, which is in the form of tube having an unclosed front end and is to be turned into the tube 7, is also produced from a metal material containing Ni and/or Fe as a primary constituent.

Next, the first intermediary coil and the second intermediary coil are welded, and the second intermediary coil and the center shaft 8 in the form of rod are welded. Then, each of the intermediary coils connected to the center shaft 8 is inserted inside the intermediary tube. And then, a front end portion of the intermediary tube is welded by arc-welding or the like, thereby joining the front end portion of the intermediary tube and a front end portion of the first intermediary coil to be turned into the heat-producing coil 9. After this, the insulating powders 10 are filled into the intermediary tube, and the sealing portion 11 is arranged between the center shaft 8 and a rear end portion opening of the intermediary tube.

Next, in a swaging step, a swaging process is performed on an entire outer circumferential surface of the intermediary tube, so that a diameter of the intermediary tube is reduced, which increases a filling density of the insulating powders 10, and thus the tube 7 with the small diameter portion 7*a* on the front end side is formed. In such a manner, the sheath heater 3 is obtained. Incidentally, in the swaging process, the first intermediary coil to be turned into the heat-producing coil 9 is subject to compressive force inwardly along a radius direction. In the first embodiment, by arbitrarily adjusting conditions of the swaging process in advance, the specific cross-sectional region 21 described above is obtained (formed) in the heat-producing coil 9 obtained after the swaging process. Namely, when obtaining the above-described specific cross-sectional region in the heat-producing coil, by arbitrarily setting the conditions of the swaging process, or by arbitrarily setting a cross-sectional shape of the intermediary coil to be turned into the heat-producing coil, which is provided to the swaging process, the specific cross-sectional region can be realized.

And the sheath heater 3 obtained in such a manner is press fitted into the through hole 4 of the housing 2, and the O-ring 12, the insulating bushings 13, and the like are arranged and fitted in, thereby obtaining the glow plug 1.

As described in detail above, according to the glow plug 1 of the first embodiment, because of being configured so that a>b is satisfied, an area ratio of the inner portion (a portion positioned in a predetermined range from the innermost portion toward the outside thereof, within the specific cross-sectional region 21) with respect to the entire specific cross-sectional region 21 can be enlarged.

In addition, the inner appearance line 221 of the specific cross-sectional region 21 is configured so as to be in the form of curved line convex toward the center axial line CL2 in the range positioned between both of the end points P1 and P3, the curved line having the curvature radius R greater than a/2, so as to satisfy the relationship L/b≤0.144, and so as to come closest to the center axial line CL2 in the range positioned between the points P1 and P3. Therefore, at the time of energizing the glow plug 1 (the heat-producing coil 9), an electric current density can be lowered in the inner portion whose area ratio is ensured larger. As a result, even when a large electric current is supplied to the glow plug 1 (the heat-producing coil 9) in order to realize a preferable rapid temperature rise, melting damage of the heat-producing coil 9 can be further surely prevented.

Moreover, because the glow plug 1 of the first embodiment is configured so as to satisfy 0.30≤a, an area of the inner portion of the specific cross-sectional region 21 can be further increased. In addition, because of being configured so as to satisfy b≤0.30 and R≥1.00, an electric current density is effectively dispersed, thereby to further surely prevent melting damage of the heat-producing coil 9.

In addition, because of being configured so as to satisfy a≤1.00, the sufficient number of turns of the heat-producing coil 9 is ensured, which makes it possible to sufficiently increase a resistive value of the heat-producing coil 9. As a result, a rapid temperature rising property of the heat-producing coil 9 can be improved. Moreover, by satisfying 0.10≤b, a preferable mechanical strength of the heat-producing coil 9 can be ensured.

Second Embodiment

Next, a glow plug according to a second embodiment is explained, centering on differences from the first embodiment. In the first embodiment, the first intermediary coil to be turned into the heat-producing coil 9 is formed of the resistive heating wire having a cross section in the form of circle. In contrast, in the second embodiment, an intermediary coil (the first intermediary coil) to be turned into a heat-producing coil 19 is formed in such a manner that a strip-shaped metal material having a cross section in the form of rectangular is helically wound so that a longer side of the cross section faces inward.

Figure 6:
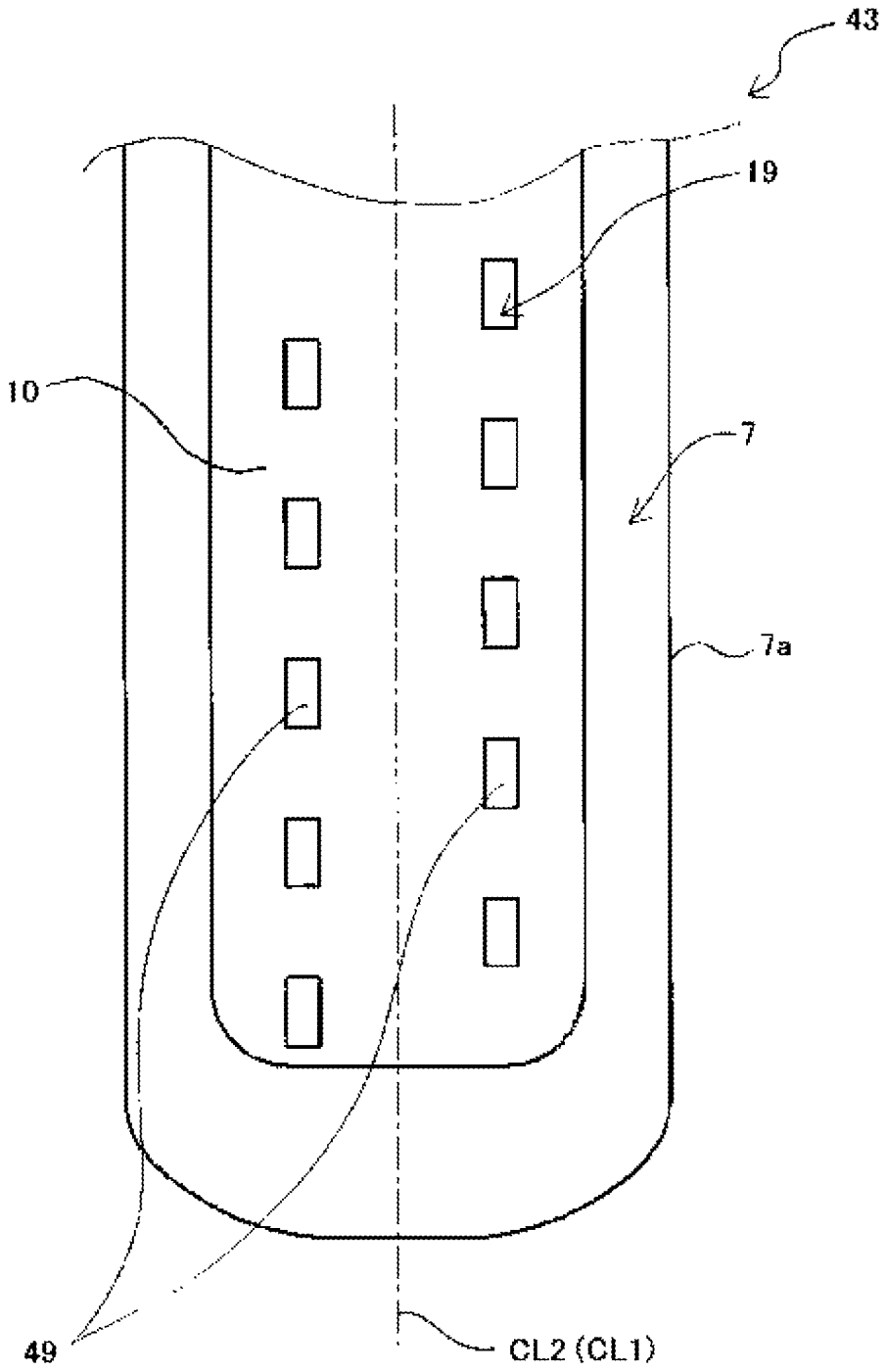
FIG. 6 is an enlarged cross-sectional view of a front end portion (a front end side portion of a sheath heater 43).
Figure 7:
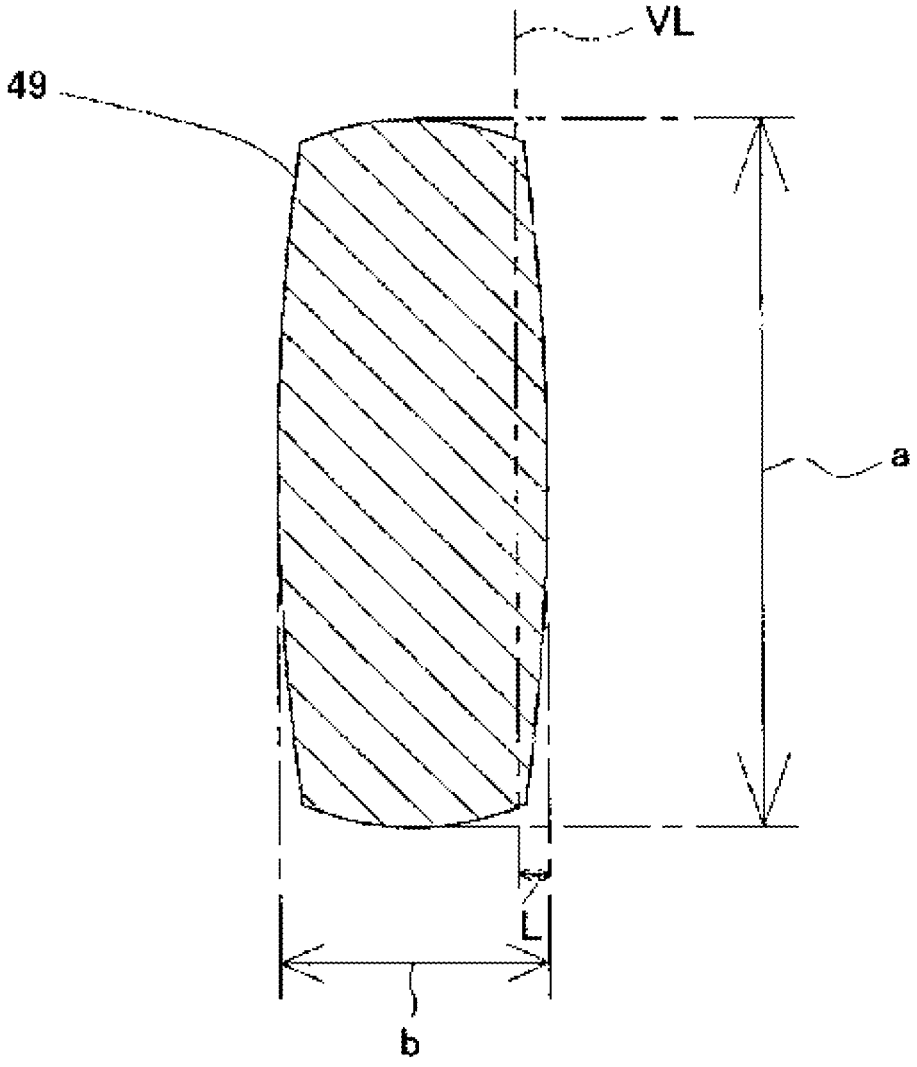
Figure 8:
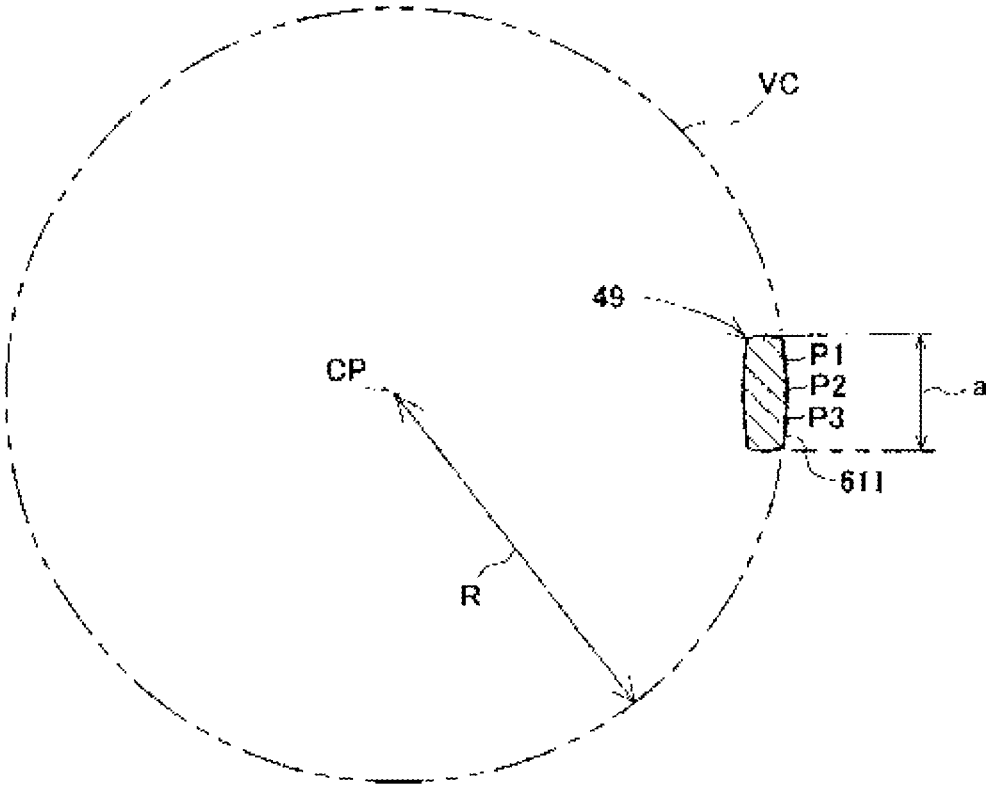
FIG. 8 is an enlarged cross-sectional view of the specific cross-sectional region, for explaining a curvature radius R.

In addition, in the swaging step, in the same manner as in the first embodiment, the first intermediary coil, the second intermediary coil, and a part of the center shaft 8 are arranged inside the intermediary tube, and then the swaging process is performed on the entire outer circumferential surface of the intermediary tube. With this, the tube 7 having the small diameter portion 7*a* at the front end thereof is formed, and thus a sheath heater 43 is obtained. Moreover, because the first intermediary coil is subject to an inward compressive force, the first intermediary coil having a rectangular cross-sectional shape, which is turned into the heat-producing coil 19, is deformed in such a manner that the cross-sectional shape is expanded. As a result, in the second embodiment, regarding the sheath heater 43 obtained through the swaging step, when observing a vertical cross section thereof including the center axial line CL2 of the tube 7, a surface positioned on the side close to the center axial line CL2 within a specific cross-sectional region 49 that is one of the cross-sectional coil regions of the heat-producing coil 19 becomes in the form of curved surface convex toward the center axial line CL2. In FIG. 6, an enlarged cross-sectional view of the glow plug (a front end side portion of the sheath heater 43) of the second embodiment is illustrated. In addition, in FIG. 7 an enlarged cross-sectional view illustrating the specific cross-sectional region 49 of the heat-producing coil 19 is illustrated, and in FIG. 8, an enlarged cross-sectional view illustrating the specific cross-sectional region 49 is illustrated, for explaining the curvature radius R.

In addition, in the glow plug of the second embodiment, in the swaging step, the first intermediary coil to be turned into the heat-producing coil 19 is processed in such a manner that, in the specific cross-sectional region 49 of the heat-producing coil 19, each of the relationships (namely, a>b, R>a/2, and 0.100<L/b≤0.144) of the first embodiment is satisfied and an inner appearance line 611 (a portion indicated by a bold line in FIG. 8) comes closest to the center axial line CL2 in a range positioned between both of the end points P1 and P3.

As above, according to the glow plug of the second embodiment, the same working effects as those of the first embodiment are obtained.

Next, in order to confirm working effects exerted by the above embodiment, plural samples of the glow plugs having different lengths a, b (mm), curvature radiuses R (mm), distances L (mm), and volume resistivities (μΩ·m) of the heat-producing coil were made, and durability assessment tests were performed on each of the samples. Incidentally, the center shaft and the control coil that is connected to the heat-producing coil are the same in each of the samples. Outlines of the durability tests are as follows.

The heat-producing coil was arranged inside the tube in such a manner that a portion of 2 mm on the side close to a rear end from a front end of the tube (a portion that becomes hottest) reaches 1000° C. within 1.5 s. And rapid heating and successive gradual cooling were repetitively performed. Then, the glow plug was disassembled, and the heat-producing coil was observed, thereby to confirm whether melting damage is caused in the heat-producing coil. Here, when no melting damage was caused in the heat-producing coil, an assessment of a "A" was made, for that melting damage of the heat-producing coil can be extremely effectively prevented.

On the other hand, when melting damage is caused in the heat-producing coil, using a sample having the same lengths a, b and the like, rapid heating the heat-producing coil in such a manner that the portion to be hottest becomes 1000° C. within a temperature rising time of 1.7 s, which was changed from 1.5 s, and then gradually cooling the same were repetitively performed. Then, it was confirmed whether or not melting damage is caused in the heat-producing coil. When no melting damage was caused in the heat-producing coil, an assessment of a "B" was made, for that melting damage of the heat-producing coil is sufficiently prevented. In addition, when melting damage was caused in the heat-producing coil even within the temperature rising time, which had been changed to 1.7 s, using a sample having the same lengths a, b and the like, rapid heating the heat-producing coil in such a manner that the portion to be hottest becomes 1000° C. within a temperature rising time of 1.9 s, which was changed from 1.7 s, and gradual cooling the same were repetitively performed. Then, it was confirmed whether or not melting damage was caused in the heat-producing coil. When no damage was caused in the heat-producing coil, an assessment of a "C" was made, for that melting damage of the heat-producing coil could be prevented. Incidentally, when melting damage was caused in the heat-producing coil was within the temperature rising time, which had been changed to 1.9 s, an assessment of "F" was made, for that melting damage was somewhat likely to be caused in the heat-producing coil.

In Table 1, test results of the durability tests are summarized. Incidentally, a temperature of the tube was measured by a radiation thermometer. In addition, a volume resistivity was changed by changing constitutional materials of the heat-producing coil. Moreover, in each of the samples, the portion positioned between both of the end points among the inner appearance line was in the form of curved line convex toward the center axial line of the tube, and was made to come closest to the center axial line.

TABLE 1

| No. | a (mm) | b (mm) | R (mm) | a/2 (mm) | L (mm) | L/b | Volume Resistivity (μΩ · m) | Assessment |
|---|---|---|---|---|---|---|---|---|
| 1 | 0.25 | 0.10 | 1.00 | 0.125 | 0.0121 | 0.121 | 1.42 | B |
| 2 | 0.90 | 0.40 | 1.50 | 0.450 | 0.0575 | 0.144 | 1.42 | B |
| 3 | 0.40 | 0.25 | 0.50 | 0.200 | 0.0357 | 0.143 | 1.42 | B |
| 4 | 0.45 | 0.30 | 3.00 | 0.225 | 0.0321 | 0.107 | 0.61 | B |
| 5 | 0.45 | 0.30 | 3.00 | 0.225 | 0.0321 | 0.107 | 1.42 | A |
| 6 | 0.60 | 0.30 | 1.00 | 0.300 | 0.0421 | 0.140 | 1.42 | A |
| 7 | 1.00 | 0.30 | 3.00 | 0.500 | 0.0412 | 0.137 | 1.42 | A |
| 8 | 0.30 | 0.60 | 1.00 | 0.150 | 0.0631 | 0.105 | 1.42 | F |
| 9 | 0.30 | 0.28 | 0.14 | 0.150 | 0.0395 | 0.141 | 1.42 | F |
| 10 | 1.00 | 0.30 | 1.00 | 0.500 | 0.0508 | 0.169 | 1.42 | C |
| 11 | 0.64 | 0.36 | 0.54 | 0.320 | 0.0561 | 0.158 | 1.42 | C |
| 12 | 0.69 | 0.47 | 0.48 | 0.345 | 0.0745 | 0.157 | 1.42 | C |

As summarized in Table 1, it has been confirmed that in samples (samples 1 to 7) that satisfy a>b, R>a/2, and L/b≤0.144, melting damage of the heater coil is effectively suppressed. This is thought to be because the following (1) and (2) function synergistically, so that an electric current flowing through the heat-producing coil flows dispersively at the time of energizing the glow plug.

(1) By setting to be a>b, an area ratio of the inner portion with respect to the entire specific cross-sectional region of the heat-producing coil becomes sufficiently large.

(2) By setting to be R>a/2 and L/b≤0.144 a portion where an electric current path becomes extremely short is not formed (in other words, a portion where an electric current is likely to flow at the time of energization is formed over a wider range along an axial line direction of the inner portion).

Moreover, as summarized in Table 1, it has been confirmed that in samples (samples 10 to 12) that satisfy a>b and R>a/2, an effect that can suppress melting damage of the heat-producing coil can be obtained under conditions that the temperature rising time is 1.9 s that falls below 2.0 s.

In addition, it has been revealed that in samples (samples 5 to 7) where a is 0.30 mm or greater, b is 0.30 mm or smaller, and R is 1.00 mm or greater, among samples (samples 1 to 3, 5 to 7) having the same volume resistivity, melting damage of the heat-producing coil can be prevented, even under a condition where the temperature rising time is 1.5 s, which is a condition where a large electric current flows in an extremely short period of time. This is thought to be caused by the facts that by setting to be 0.30≤a, an area of the inner portion of the specific cross-sectional region can be increased, and that by setting to be b≤0.30 and R≥1.00, the portion (surface) positioned on the side close to the center axial line, within the specific cross-sectional region, is further surely suppressed from being bulged toward the center axial line, so that the electric current density can be effectively dispersed.

Moreover, it has been found that paying attention to samples (samples 4, 5) that are different only in a volume resistivity, a sample (sample 5) having a volume resistivity of 1.0 μΩ·m or greater is more excellent in terms of a melting damage prevention effect of the heat-producing coil.

From the durability test results above, it has been found that, in order to prevent melting damage of the heat-producing coil, it is preferable to apply the heat-producing coil that satisfies a>b and whose portion positioned between both of the end points within the inner appearance line of the specific cross-sectional region is in the form of convexly curved line that satisfies R>a/2. In addition, from the durability test results above, it can be said that, in order to further surely prevent melting damage of the heat-producing coil due to concentration of the electric current density, it is preferable to apply the heat-producing coil that satisfies a>b and L/b≤0.144, and whose portion positioned between both of the end points, within the inner appearance line of the specific cross-sectional line, is in the form of convexly curved line that satisfies R>a/2. In addition, it can be said that, in order to further effectively prevent melting damage of the heat-producing coil, the heat-producing coil (the specific cross-sectional region) is preferably configured so as to satisfy 0.30≤a, b≤0.30, and R≥1.00, and a volume resistivity of the heat-producing coil is preferably set to be 1 μΩ·m or greater.

Incidentally, the present invention is not limited to written contents of the above embodiments, but practiced in the following manner. Obviously, other applications and modifications that are not exemplified below are naturally possible.

Figure 9:
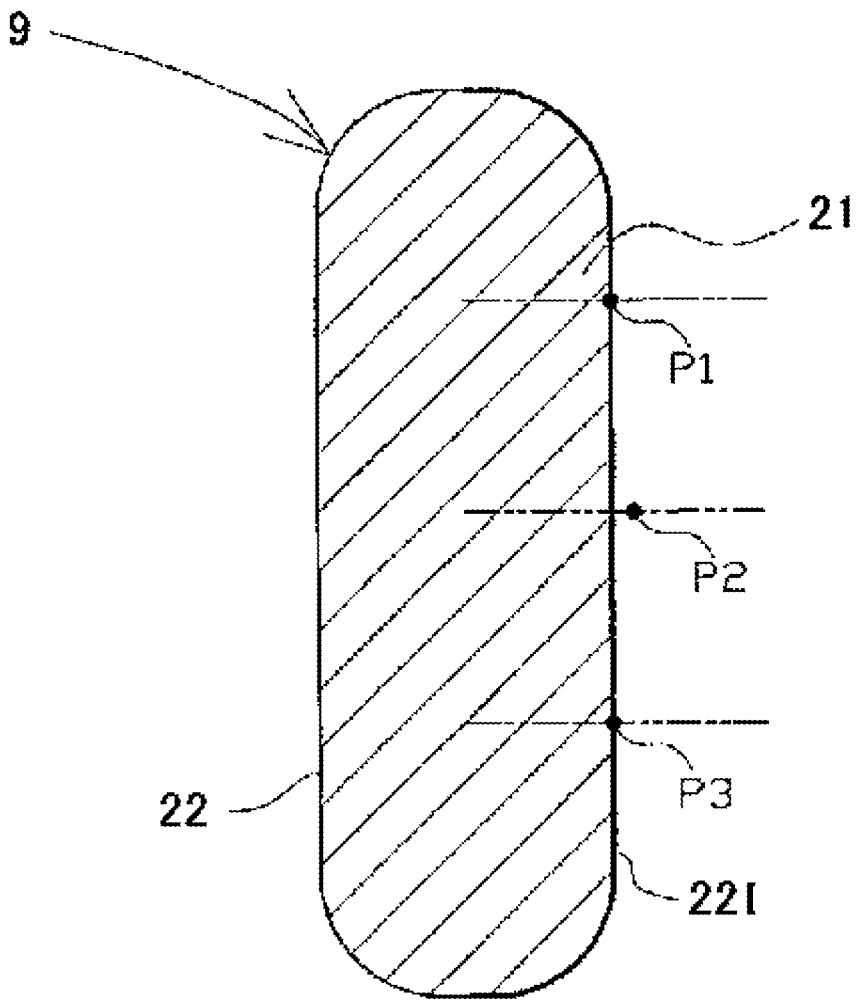
FIG. 9 is an enlarged cross-sectional view illustrating a coil cross-sectional region (a specific cross-sectional region) in another embodiment.

(a) While in the first embodiment the inner appearance line 221 of the specific cross-sectional region 21 of the heat-producing coil 9 is in the form of convexly curved line in the range positioned between the points P1 and P3, the inner appearance line 221 may be configured in the form of straight line in the range positioned between the points P1 and P3, as illustrated in FIG. 9 (in other words, the curvature radius R may be extremely large). Even in this case, when a large electric current is supplied to the glow plug, melting damage of the heat-producing coil 9 can be prevented in the same manner as the above embodiments.

(b) Shapes or the like of the glow plug 1 are not limited to those in the above embodiments. For example, the tube 7 may be in a straight shape having substantially a constant outer diameter. In addition, the large diameter portion 4*a* of the through hole 4 may be omitted, and the tube 7 may be press fitted into and fixed in the housing 2 having the through hole 4 in a straight form along the direction of the axial line CL1.

(c) The glow plugs in the above embodiments are configured so that the control coil is intervened between the heat-producing coil and the center shaft. However, the control coil may be omitted, and a configuration where the heat-producing coil and the center shaft may be directly connected may be employed.

1 . . . glow plug, 2 . . . housing, 3,4 . . . sheath heater, 7 . . . tube, 8 . . . center shaft, 9, 19 . . . heat-producing coil, 10 . . . insulating powders, 16 . . . control coil, 21,49 . . . specific cross-sectional region, 221, 611 . . . inner appearance line, CL1 . . . axial line, CL2 . . . center axial line, VL . . . virtual straight line.

The invention claimed is:

1. A glow plug comprising:

a tubular tube that extends along a direction of an axial line and is closed at a front end portion thereof; and a heat-producing coil that is helically wound, arranged inside the tube substantially coaxially with the tube, and joined at an own one end to the front end portion of the tube, wherein, in a specific cross-sectional region that is one of cross-sectional coil regions of the heat-producing coil observed in a vertical cross-sectional surface including a center axial line of the tube, a>b is satisfied, wherein a (mm) is a length of the specific cross-sectional region along the direction of the axial line, and b (mm) is a length of the specific cross-sectional region along a direction perpendicular to the axial line, and an inner appearance line, which is a line segment positioned on the side close to the center axial line within an appearance line of the specific cross-sectional region, is in a form of a straight line or a curved line, the curved line being convex toward the center axial line so that R>a/2 is satisfied wherein R is a curvature radius R (mm), in a range positioned between both end points among three points that divide the inner appearance line into quarters along the axial line direction, and wherein when L (mm) is defined as a distance along the direction perpendicular to the axial line from a portion closest to the center axial line within the inner appearance line through a virtual straight line drawn at a position in the specific cross-sectional region in parallel with the axial line, the position allowing an area of the thus formed region closer to the inner appearance line to be 10% of an entire area of the specific cross-sectional region, $0.100<L/b\leq0.144$ may be satisfied.

2. The glow plug according to claim 1, wherein the inner appearance line in the specific cross-sectional region is in a form of a curved line convex toward the center axial line in the range positioned between the both end points, and wherein $0.03\leq a\leq1.00$, $0.010\leq b\leq0.30$, and $R\geq1.00$ are satisfied.

3. The glow plug according to claim 1, wherein the heat-producing coil has a volume resistivity of 1.0 μΩ·m or greater.

* * * * *